US008678750B2

(12) United States Patent
Seitz

(10) Patent No.: US 8,678,750 B2
(45) Date of Patent: Mar. 25, 2014

(54) SPECIALTY PUMP WITH HEAT EXCHANGER AND SYSTEM

(75) Inventor: Douglas W. Seitz, Eau Claire, WI (US)

(73) Assignee: W. S. Darley + Co., Itasca, IL (US)

( * ) Notice: Subject to any disclaimer, the term of this patent is extended or adjusted under 35 U.S.C. 154(b) by 506 days.

(21) Appl. No.: 13/088,828

(22) Filed: Apr. 18, 2011

(65) Prior Publication Data

US 2011/0255960 A1 Oct. 20, 2011

Related U.S. Application Data

(60) Provisional application No. 61/326,091, filed on Apr. 20, 2010.

(51) Int. Cl.
*F04D 29/42* (2006.01)

(52) U.S. Cl.
USPC ..... 415/112; 415/176; 415/178; 415/214.1

(58) Field of Classification Search
USPC ..... 415/112, 175, 176, 177, 178, 182.1, 415/206, 214.1; 417/313; 184/26, 27.1
See application file for complete search history.

(56) References Cited

U.S. PATENT DOCUMENTS

| | | | | |
|---|---|---|---|---|
| 3,957,402 | A | 5/1976 | Sloan | |
| 4,122,818 | A | 10/1978 | Hattori | |
| 4,351,391 | A | 9/1982 | Eberhardt | |
| 4,903,760 | A | 2/1990 | Joshi et al. | |
| 5,823,250 | A | 10/1998 | Barten et al. | |
| 6,997,238 | B1 | 2/2006 | Ruthy et al. | |
| 2002/0146319 | A1 * | 10/2002 | Dorsch et al. | 415/206 |
| 2008/0141800 | A1 * | 6/2008 | Seitz et al. | 74/15.82 |

* cited by examiner

*Primary Examiner* — Edward Look
*Assistant Examiner* — Juan G Flores
(74) *Attorney, Agent, or Firm* — Anthony J. Bourget

(57) ABSTRACT

A specialty pump and heat exchange system having a fluid pump driven by a gear assembly. The fluid pump has a pump casing and an inboard head that form a fluid passageway when connected together. The gear assembly uses lubricant in the transmission and that lubricant is cooled by being pumped from the gear assembly through a lubricant passageway in the inboard head and then recycled back to the gear assembly for further use. In addition to cooling the lubricant, the system warms the fluid pump and/or fluid passing through the fluid pump.

16 Claims, 6 Drawing Sheets

SPECIALTY PUMP WITH HEAT EXCHANGER AND SYSTEM

RELATED APPLICATIONS

This application claims the benefit and priority of Provisional Patent Application Ser. No. 61/326,091 filed Apr. 20, 2010, for a SPECIALTY PUMP AND HEAT EXCHANGER under 35 U.S.C. §119(e), incorporated herein by reference.

BACKGROUND OF THE INVENTION

1. Field of the Invention

The present inventive concept relates generally to fluid pumps and heat exchange systems, and more specifically to fluid pumps interacting with lubricants used in systems powering the fluid pump.

2. Background Information

Gearboxes, including those powering fluid pumps, encase various gears used for transferring mechanical power. Generally gears within a sealed gearbox are surrounded with oil or other lubricant to reduce friction. During operation the transfer of mechanical power produces heat and friction within the gears, gearbox, and oil or other lubricant. Excessive heat within the gearbox, especially for prolonged periods can be disastrous, resulting in breakdown of lubricant and failure of the gears, gear exchange, bearings, and gearbox. Thus, various efforts have been made to reduce the heat within the gearbox.

One system for reducing the heat within the gearbox includes introducing a coolant source directly within the gearbox. Such system may include use of a copper tube inserted within the gearbox cavity. A coolant such as cool water or other cool liquid is pumped, sometimes continuously, through the copper tube which thereby cools the interior of the gearbox.

In addition to the above technique, some other systems, such as the assembly shown in Ruthy et al. under U.S. Pat. No. 6,997,238, pump a cooled fluid to a gearbox cooler plate, through which the cooling fluid cools the casing of the gearbox and thus cools the lubricant within the gearbox. Other systems also exist for cooling the oil of a gearbox transmission used for operation of a firefighting pump.

While the prior art has provided examples of oil lubricant cooling systems, there is always room for further improvement.

SUMMARY OF THE INVENTION

The present inventive concept is directed toward a specialty pump and also a heat exchange device. The specialty pump is a centrifugal pump having a casing in part defining a fluid passageway together with an inboard head connected to the casing and in part defining the fluid passageway and where the inboard head has a common wall in part defining a lubricant or oil passageway, the common wall separating the lubricant passageway from the fluid passageway. Unlike other systems, the present device involves using the pump to cool lubricant used for powering itself.

Further aspects of the inventive heat exchange system include a gearbox having a lubricant chamber, a lubricant pump and the specialty water pump, where lubricant is pumped by the lubricant pump from the lubricant chamber to the specialty pump and via a path that has a common wall with a waterway of the water pump and back to the lubricant chamber. The inventor has realized advantages of this inventive apparatus and system and method of using and manufacturing the apparatus over prior art pumps and heat exchanging devices and methods of using and manufacturing those devices.

An object of the invention is to provide a heat exchange device that cools lubricant (e.g., oil) by pumping the lubricant through a passageway of a water pump.

An object of the invention is to provide a heat exchange device that warms, and thus prevents freezing of, a fluid pump (and the fluid therein) by pumping warm lubricant through the casing (or passageway) of a fluid pump.

An object of the invention is to provide a heat exchange device for cooling lubricant and warming a fluid pump that precludes the need for seals directly between flowing lubricant and another fluid flowing through the fluid pump.

An object of the invention is to provide a heat exchange device to cool oil, where a fire pump is used as part of the heat exchange device.

An object of the invention is to provide a pump having a heat exchange feature within itself to cool oil from a gearbox used to power itself.

An object of the invention is to provide a pump having a lubricant passageway that shares a wall with a waterway of the pump in order to circulate and cool the lubricant.

The above summary of the present invention is not intended to describe each illustrated embodiment, aspect, or every implementation of the present invention. The figures and detailed description that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
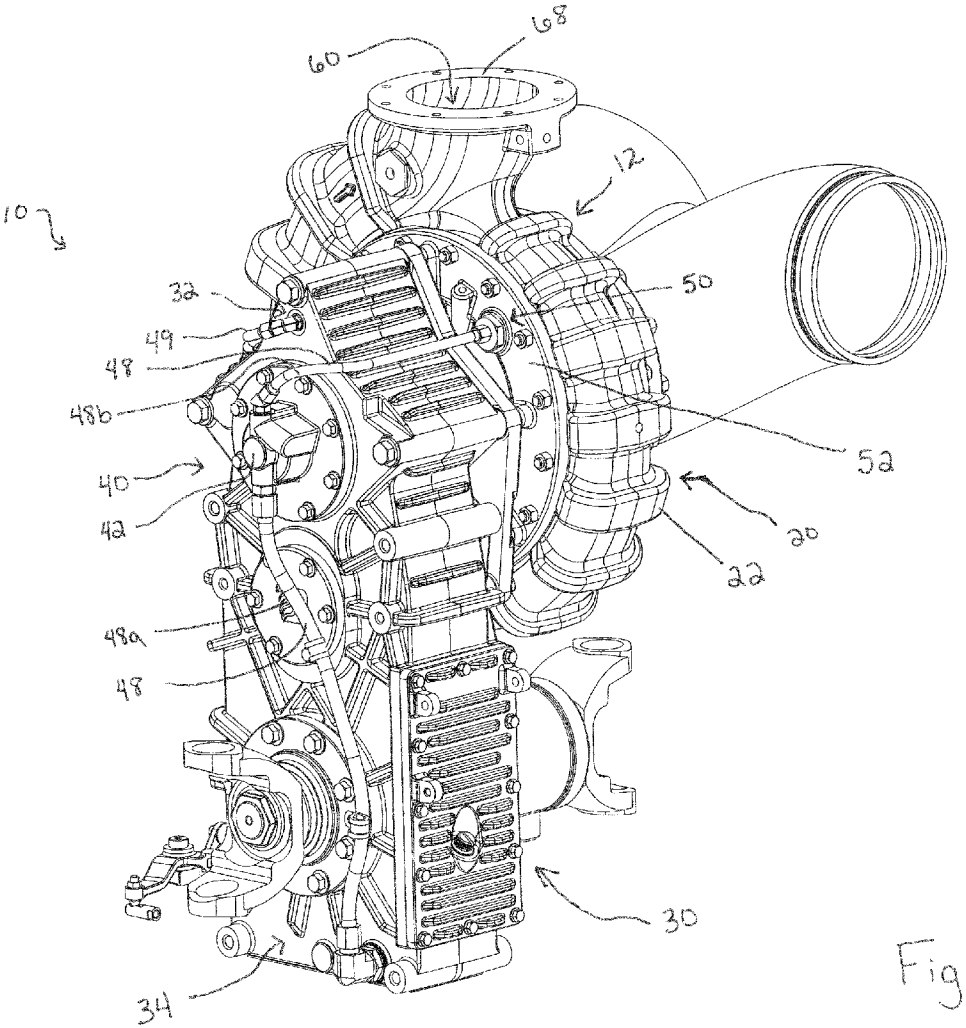
FIG. 1 is a perspective view of an embodiment of the invention.

While the invention is amenable to various modifications and alternative forms, specifics thereof have been shown by way of example in the drawings and will be described in detail. It should be understood, however, that the intention is not necessarily to limit the invention of the particular embodiments described.

DETAILED DESCRIPTION OF THE INVENTION

The invention is directed to a specialty fluid pump 12, and also to a heat exchange system 10 which includes pump 12. System 10 comprises a gearbox 30 having a cavity with a lubricant, i.e., oil, chamber defined therein, a lubricant (oil) pump 40 and specialty fluid pump 12. Lubricant such as oil is pumped by the oil pump 40 from the oil chamber through a passageway 54 of pump 12 that shares a common wall 53 with a waterway 60 of water pump 12 and back to the oil chamber within gearbox 30. Using oil as a lubricant is a preferred and any lubricant capable of properly lubricating gearbox 30 and its contents may be utilized.

Generally, the gears of a gearbox which run a centrifugal pump 12, have an oiling system to keep the gears running smoothly. Typically the gears will cause oil in the gearbox 30 to splash about which may effectively lubricate the system. Yet when higher powered systems are desired, such splash-lubrication may be insufficient to provide adequate cooling/lubrication. In the present system, the oil of the oiling system may be applied to the gears from a top portion, such as a first position 32, of gearbox 30 and the oil may pool in a bottom portion, a second position 34, of gearbox 30 due to gravity. Due to heat caused by the operation of the gear drive system within gear box 30, the oil running through the oiling system may heat up and if the oil is not cooled, it may heat to an undesirable temperature, resulting in degradation/loss of oil and undue wear to the gears or other components. The inventive oil pump heat exchanging system 10 may act to cool the oil prior to the oil reaching an undesirable temperature.

As seen in FIG. 1, gearbox 30 is connected to water pump 12 (e.g., a fire pump 20), where gears of gearbox 30 may work with other moving pieces to operate fire pump 20. Gearbox 30 may be of a common variety for use in an apparatus where various gears and shafts interchange or connect. Gearbox 30 may also be a gearbox used on a fire truck or firefighting apparatus. Gearbox 30 is designed to power a water pump 12, such as a pump used on a fire truck for fighting fires. Gearbox 30 may comprise an oiling system to ensure the gears and shafts within gearbox 30 remain well lubricated. The oiling system applies oil to gears of gearbox 30 from a top portion of gearbox 30 and then allows the oil to pool at a bottom portion of (e.g., a second position within) gearbox 30, where it may be removed by oil pump 40.

Oil pump 40 pumps the oil of gearbox 30 to, and through, fire pump 20 in order to cool the heated oil. As disclosed in FIG. 1, oil pump 40 may comprise supply tubes 48, oil pump hub 42 and a discharge tube 49. Oil pump 40 may pump heated oil from gearbox 30 through a first supply tube 48*a* to oil pump hub 42 and from oil pump hub 42 to fire pump 20 via second supply tube 48*b*.

Once heated oil has been pumped to fire pump 20, the heated oil enters fire pump 20 through an oil inlet port 50 located on an exterior portion or through exterior wall surface 52*a* of inboard head 52. Inboard head 52 forms one segment of the casted exterior of water pump 12; another segment comprises the pump casing 22. A further segment may include outboard head 84 (See FIG. 2). Inboard head 52, pump casing 22 and outboard head 84 are connected together to form fire pump 20. Head 52 and casing 22 are typically connected with bolts 74. An impeller 78 is positioned within centrifugal pump 20 which spins (via power from the gearbox 30 which spins impeller shaft 82) and propels fluid through fluid passageway 60 which exits outlet port 68. Fluid exiting outlet port 68 is high pressure fluid used for firefighting purposes, for instance.

Figure 2:
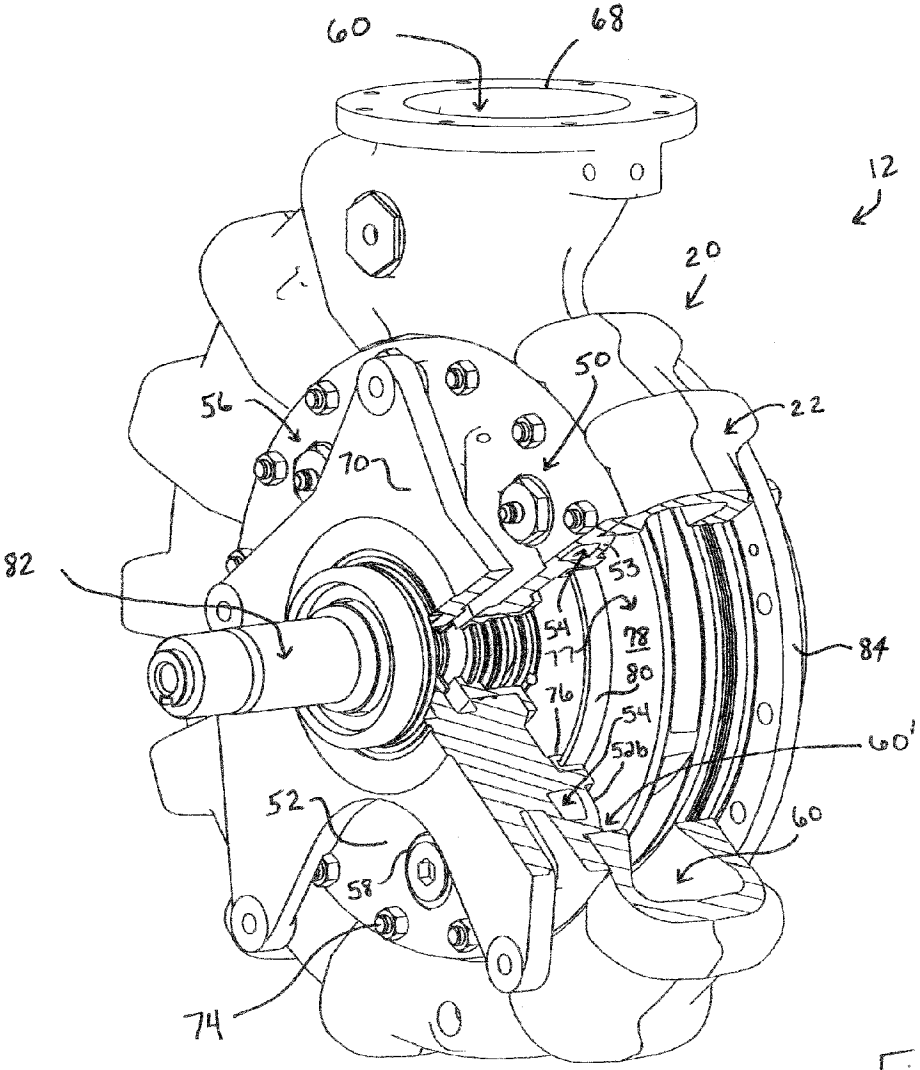
FIG. 2 is a perspective view of a specialty pump embodiment of the invention with a portion of the pump removed for clarity.

Inboard head 52 includes an exterior wall surface 52*a* and an interior wall surface 52*b*. Exterior wall surface 52*a* is a portion of inboard head 52 that is not in contact with water or other fluid which circulates through fluid passageway 60 of pump 20. Passageway 60 receives water or fluid from spinning impeller 78. The water or fluid circulates around the inside of pump casing 22 as is known in the art. Passageway 60 includes passageway 60' which generally defines a passageway that spans along an impeller side wall 78 as shown in FIG. 2. Passageway 60' is generally defined by side wall 78, casing 22 and wall surface 52*b*. Interior wall surface 52*b* is a portion of inboard head 52 at least partially in contact with water or other fluid which circulates through fluid passageway 60' of pump 20. It may be appreciated that fluid communicating with passageway 60 also communicates with passageway 60'.

Inboard head 52 includes common wall 53. Common wall 53 comprises a portion of interior wall surface 52*b* and first side interior wall surface 62 (See FIG. 4). Common wall 53 defines in part fluid passageway 60'. Common wall 53 defines in part interior oil passageway 54. Second side interior wall surface 65 (See FIG. 6) is positioned generally opposite wall surface 62 and in part defines oil passageway 54. Inboard head 52 forms a seal and preferably a hermetic seal with pump casing 22. Interior wall portion 52*b'* abuts pump casing 22 to form a sealed fit. Shelf 55 of inboard head 52 also abuts pump casing 22 to from a seal. Impeller 77 includes seal rib 80 which projects from and runs along impeller side wall 78 as shown in FIG. 2. Seal ring 76 receives seal rib 80 of impeller 77 to seal fluid between a discharge portion of pump 12 and a suction or lower pressure portion of pump 12. Seal rib 80 spins through seal ring 76 during operation of impeller 77.

Common wall 53 allows for thermal communication between interior oil passageway 54 and fluid passageway 60, 60'. Heat is exchanged through wall 53 as heated oil passes through passageway 54 while cooler fluid passes through passageway 60'. It may be appreciated that thermal communication results in cooling of the oil circulating through passageway 54 and heating of the fluid circulating through passageway 60'. In this case heat transfer involves the lowering of temperature of the heated oil passing through passageway 54. The temperature of fluid within passageway 60' is lower than the temperature of the oil within passageway 54. The temperature of oil exiting outlet port 56 is lower than the temperature of oil entering through port 50.

Figure 6:
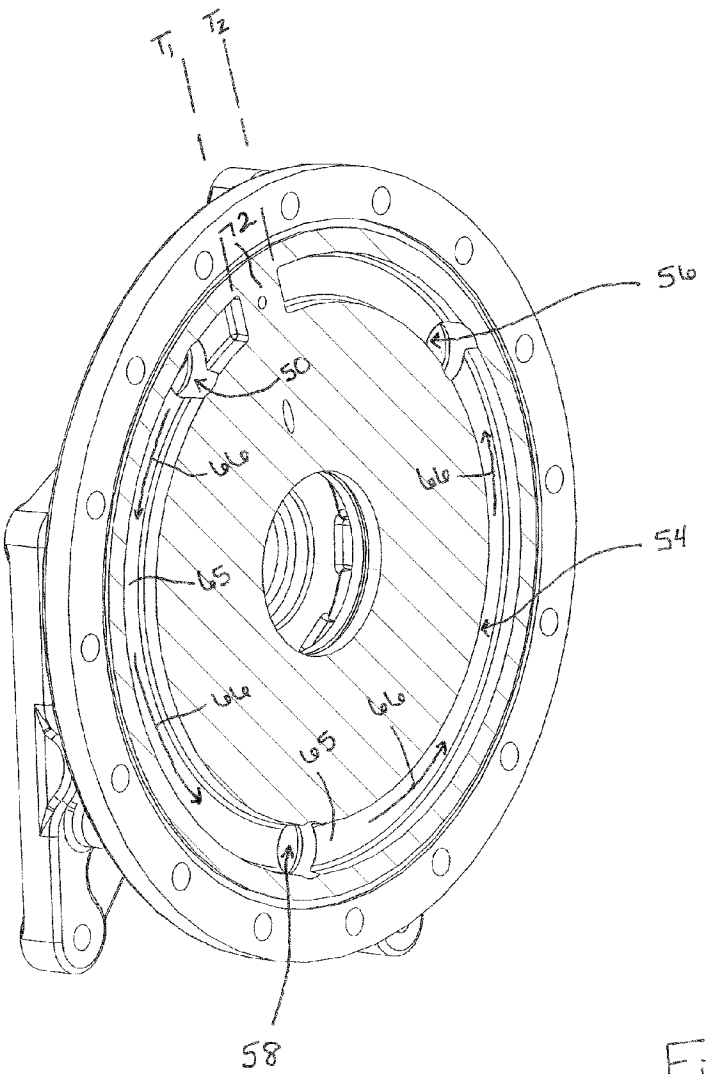
FIG. 6 is a perspective cross-section view of the features of the invention taken along line 6-6 of FIG. 5.

Once heated oil enters inboard head 52 through inlet port 50, the oil may be forced by oil pump 40 and forces from other sources, through interior oil passageway 54. Generally, the oil may circulate in the direction of arrows 66, as depicted in FIG. 6. Rib 72 promotes flow of the oil in the direction of arrows 66. Once the oil circulates through interior oil passageway 54 and is cooled (i.e., heat energy is removed from the oil), the oil may exit inboard head 52 via oil outlet port 56 and may be pumped, via oil pump 40 and discharge tube 49, to gearbox 30 where the cooled oil may re-enter the gearbox 30 oiling system. Discharge tube 49 may connect at outlet port 56. As seen in FIG. 1, discharge tube 49 may connect to an upper portion of gearbox 30 (i.e., at a first position 32 within gearbox 30) to allow oil to flow downward within gearbox 30. Heat is exchanged about common wall 53 as heated oil passes along wall 53 through passageway 54 and as cooler water/fluid passes along wall 53 though fluid passageway 60.

Figure 3:
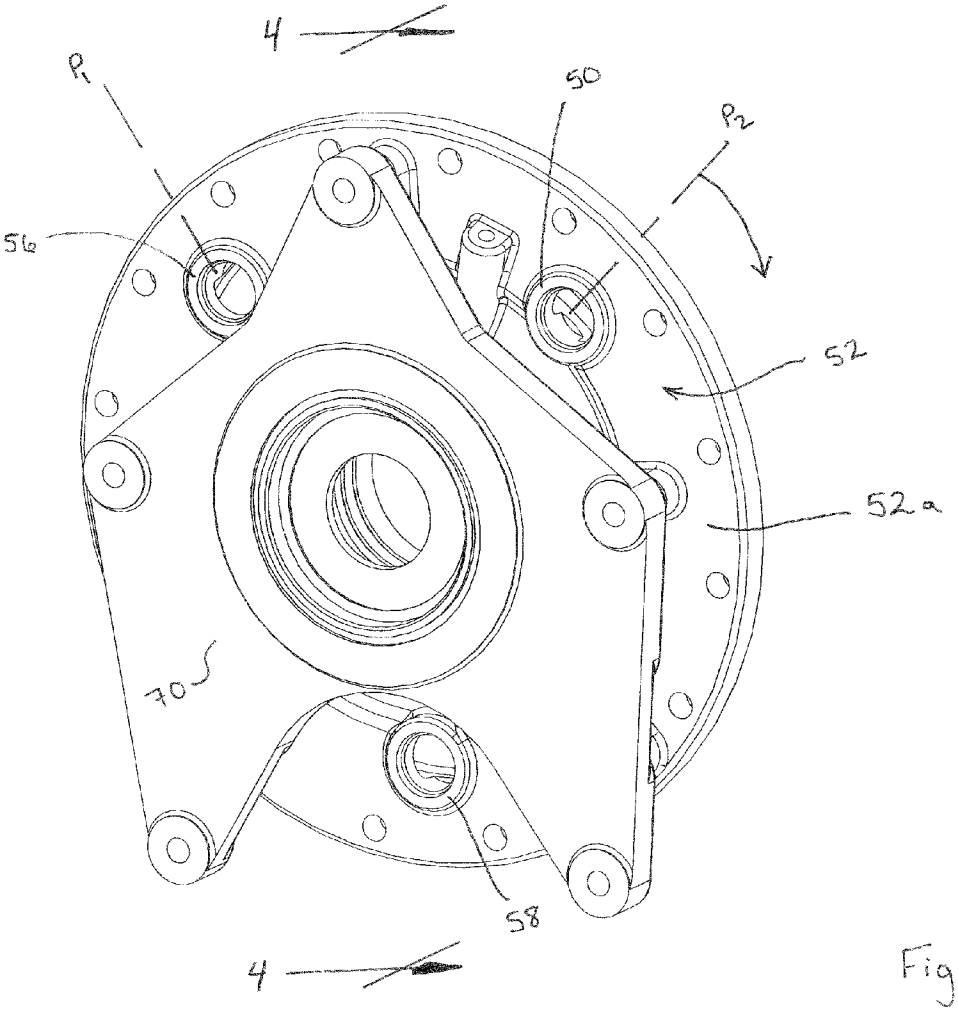
FIG. 3 is a perspective view of features of the invention.

FIGS. 2-6 display varying views of portions of fire pump 20 including pump-casing 22, where pump casing 22 connects with inboard head 52. Inboard head 52 may comprise three ports, oil inlet port 50, oil outlet port 56 and oil drain portion 58, as seen in FIGS. 2 and 3. Additional or fewer ports may be utilized. Ports 50, 56, and 58 are positioned as shown during the casting process of inboard head 52.

In order to create oil passageway 54, a special casting process is used. Particularly a sand, foam or other molding element is configured in the shape of passageway 54 within the mold used to create inboard head 52. When casting of head 52 is completed, the sand, foam or other molding element is removed (or evaporates) through ports 50, 56 and 58, or some of them. It may be appreciated that passageway 54 is casted in place or made using a "cast in place" method. Applicant has preferably positioned the sand removing ports to coincide with the useful oil ports 50, 56, and 58. Ports 50, 56, 58 may have been placed in different positions, yet applicant has advantageously positioned port 58 at a relatively lower area of inboard head 52 for draining purposes while positioning ports 50 and 56 at upper portions in order to maximize the travel distance of passageway 54.

As may be appreciated from the Figures, passageway 54 runs substantially around a center of inboard head 52. In one aspect passageway 54 may be oriented in a substantially circular path within inboard head 52. It may be appreciated that other orientations of passageway 54 may be used and that the path is not limited to the orientation shown in the Figures. Preferably the orientation of the path traveled by passageway 54, and the surface area of interior wall surface 52*b* of common wall 53, are configured or maximized to allow for greatest heat transfer between oil within passageway 54 and fluid within passageway 60'. While a greater or lesser travel distance may be used, passageway 54 may approach a travel distance of about 360 degrees. As shown in FIG. 6, the travel distance of passageway 54 spans counter-clockwise from reference line T1 to reference line T2. As shown in the Figures the travel distance of passageway 54 is greater than about 270 degrees. It may be appreciated that the travel distance of passageway 54 may be less than 270 degrees. As shown in FIG. 3, the travel distance D1 of passageway 54 from port 50 to port 56 spans clockwise from reference line P2 to reference line P1. Ports 50, 56, 58 may provide access to and from interior oil passage way 54. More specifically, ports 50, 56, 58 may be the oil access points to and from oil passage way 54. Ports, 50, 56, 58 may connect to various tubes or other devices that facilitate carrying heated and cooled oil to and from interior oil passageway 54. Particularly, oil drain port 58 may be used to flush or clean interior oil passageway 54 when system 10 is not being used.

Inboard head 52 may be formed by any method capable of forming inboard head 52 as a unitary piece of material; for example, inboard head 52 may be formed by a molding or casting process. Inboard head 52 may have an exterior wall surface 52*a* and an interior wall surface 52*b*. The specific configuration of inboard head 52 with ports 50, 56, 58 positioned at exterior wall surface 52*b*, may allow heated oil to be cooled through inboard head 52. Instead of the requirement to pass the heated oil through a separate or additional heat exchanger, applicant has created the special pump 12 to operate as the heat exchanger. Water pump 12 becomes the heat exchanger to cool oil that is used for the transmission that powers water pump 12.

Figure 4:
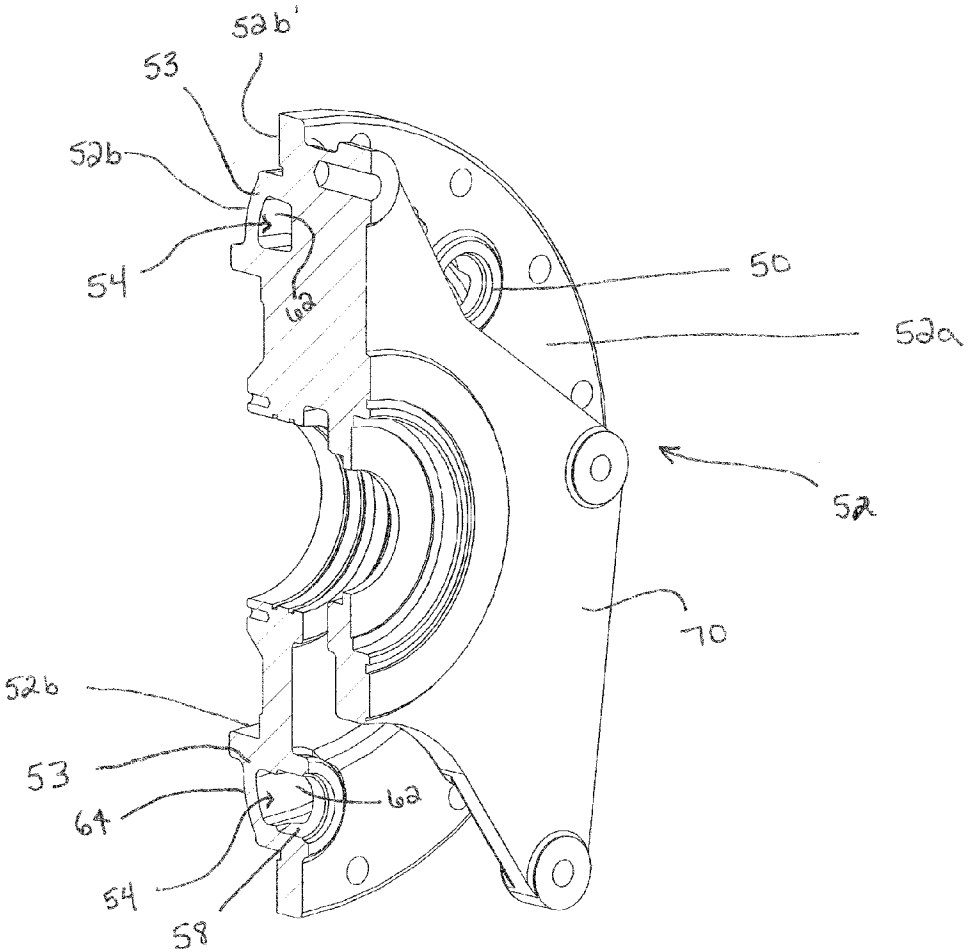
FIG. 4 is a perspective cross-section view of features of the invention taken along line 4-4 of FIG. 3.
Figure 5:
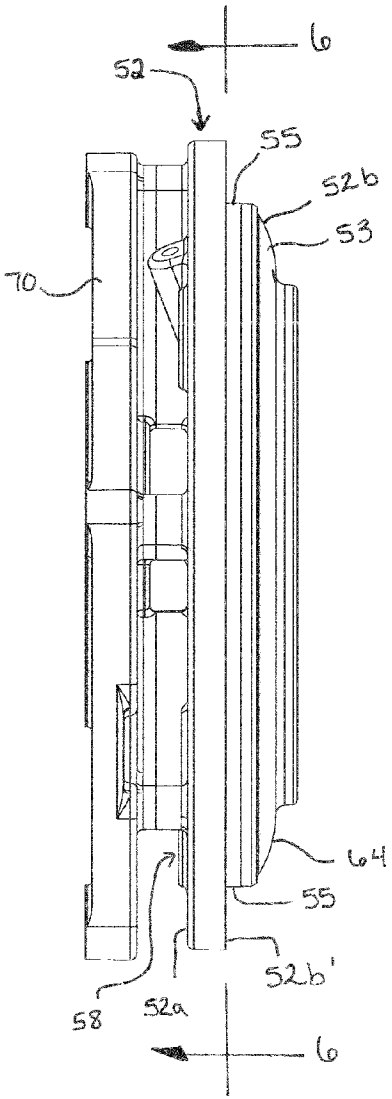
FIG. 5 is a side view of features of the invention.

Use of pump 12 with its internal oil passageway 54 allows for placement of the hot oil in relatively close contact with the cooling water, without actually mixing (i.e., avoiding direct physical contact between) the oil and water. Instead of running the oil to an exterior surface of the pump, which would also require a seal or gasket, the oil is delivered through the special oil passageway 54 positioned in close relationship with fluid passageway 60, 60' of the pump. Oil passageway 54 is integrated with inboard head 52 of pump 12, as seen in FIGS. 4 and 6. No separate or additional heat exchange device is required. Common wall 53 forms a direct wall between the heated oil and cooled water. Common wall 53 may be the primary location of heat exchange as the warm oil passes through interior oil passageway 54 on a first side 62 of common wall 53 and a cool fluid (e.g., water) may pass through fluid passageway 60' along a second side 64 of common wall 53. Moreover, due to the circulation of the oil through interior oil passageway 54, the heated oil may be cooled and fire pump 20 (and fluid within passageway 60) may be heated. In some temperature situations the heating of the liquid within passageway 60' will help to avoid or minimize freezing of liquid within passageway 60'. Common wall 53 may be of a thickness and configuration appropriate for use with a high powered liquid pump for firefighting purposes. It may be appreciated that common wall 53 may vary in thickness in order to accommodate different heat exchange rates. It may also be appreciated that common wall 53 may have a length and configuration that varies such that passageway 54 may have varying dimensions in terms of configuration and volume and surface area exposed to fluid passageway 60'.

A further aspect of the invention includes a method of cooling the oil of a gearbox of a heat exchange system where the system includes a fluid pump powered by the gearbox and where the fluid pump includes the features of pump 20 described above. A further aspect of the invention includes warming the fluid pump (and fluid within the pump) of a heat exchange system where the system includes a fluid pump powered by the gearbox of the system. The warming method may further include moving oil from a first position within a cavity of the gearbox to the fluid pump 20 and moving the oil through the fluid pump and heating the fluid passing through the fluid pump and moving the oil from the fluid pump to a second position within the cavity of the gearbox.

Inboard head 52 also operates as a heater plate 52 for attachment to centrifugal pump casing 22 in order to supply heated fluid in contact with common wall 53 forming a fluid passageway 60' through the centrifugal pump casing 22 to warm the centrifugal pump 20 and fluid passing therethrough.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise specifically indicated. While the particular SPECIALTY PUMP WITH HEAT EXCHANGER AND SYSTEM as herein shown and described in detail is fully capable of attaining the above-described aspects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

What is claimed is:

1. A centrifugal pump comprising:

a casing in part defining a fluid passageway; and an inboard head connected to said casing and in part defining said fluid passageway;

said inboard head having a common wall in part defining an oil passageway, said common wall separating said oil passageway from said fluid passageway.

2. The pump of claim 1 where said oil passageway is casted in place.

3. The pump of claim 1 where said inboard head further comprises:

an inlet port communicating with said oil passageway; and an outlet port communicating with said oil passageway.

4. The pump of claim 3 where said passageway has a travel distance from said inlet port to said outlet port, said travel distance being greater than 45 degrees of rotation.

5. The pump of claim 3 where said inboard head further comprises an oil drain port.

6. A centrifugal pump comprising:

a gearbox assembly; and a fluid pump comprising:

a casing;

an inboard head, where said casing and said inboard head define a fluid passageway of said fluid pump; and an oil supply port defined by said inboard head and through which said port is capable of receiving oil from said gearbox assembly.

7. The pump of claim 6 further comprising an oil pump capable of pumping oil from said gearbox assembly through an oil supply tube to said inboard head.

8. The pump of claim 6 further comprising an oil passageway defined by said inboard head and said oil passageway fluidly communicates with said gearbox assembly.

9. The pump of claim 8 where said oil passageway is in thermal communication with said fluid passageway.

10. The pump of claim 6 where said inboard head includes a common wall, said common wall in part defining an oil passageway within said inboard head and in part defining said fluid passageway.

11. The pump of claim 6 where said gearbox assembly is connected to said inboard head.

12. The pump of claim 11 where said fluid pump includes an impeller connected to an impeller shaft driven by gears from within said gearbox assembly.

13. A heat exchange system for cooling lubricant used in a gearbox configured to drive a centrifugal pump, said system comprising:

a gearbox assembly; and a fluid pump connected with said gearbox assembly, said fluid pump comprising:

a casing;

an inboard head having a common wall in part defining a lubricant passageway within said inboard head; and an impeller, where said impeller and said common wall in part define a fluid passageway of said fluid pump.

14. The heat exchange system of claim 13 where thermal transfer occurs at said common wall as heated lubricant passes through said lubricant passageway while cooler fluid passes through said fluid passageway.

15. The heat exchange system of claim 13 where said lubricant passageway is oriented in a generally circular path within said inboard head.

16. The heat exchange system of claim 13 further comprising a lubricant pump capable of pumping lubricant from said gearbox assembly through a lubricant supply tube to said inboard head.

* * * * *